US008091652B2

(12) United States Patent
Sinnerstad et al.

(10) Patent No.: US 8,091,652 B2
(45) Date of Patent: Jan. 10, 2012

(54) METHOD AND DEVICE FOR CONTROLLING AT LEAST ONE DRILLING PARAMETER FOR ROCK DRILLING

(75) Inventors: Jonas Sinnerstad, Örebro (SE); Magnus Olsson, Hallsberg (SE); Marcus Leü, Fjugesta (SE)

(73) Assignee: Atlas Copco Rock Drills AB, Orebro (SE)

( * ) Notice: Subject to any disclaimer, the term of this patent is extended or adjusted under 35 U.S.C. 154(b) by 193 days.

(21) Appl. No.: 12/450,700

(22) PCT Filed: Apr. 9, 2008

(86) PCT No.: PCT/SE2008/000257

§ 371 (c)(1), (2), (4) Date: Oct. 6, 2009

(87) PCT Pub. No.: WO2008/127173

PCT Pub. Date: Oct. 23, 2008

(65) Prior Publication Data

US 2010/0108381 A1 May 6, 2010

(30) Foreign Application Priority Data

Apr. 11, 2007 (SE) ..... 0700885-7

(51) Int. Cl.
*E21B 44/00* (2006.01)

(52) U.S. Cl. ..... 175/24; 175/56

(58) Field of Classification Search ..... 175/24, 175/26, 40, 48, 56

See application file for complete search history.

(56) References Cited

U.S. PATENT DOCUMENTS

| | | | |
|---|---|---|---|
| 3,822,752 | A | 7/1974 | Montabert |
| 3,971,449 | A | 7/1976 | Nylund et al. |
| 4,699,223 | A | 10/1987 | Noren |
| 6,637,522 | B2 | 10/2003 | Wilson et al. |
| 6,938,702 | B2 | 9/2005 | Saha et al. |
| 7,124,578 | B2 | 10/2006 | Noel |

FOREIGN PATENT DOCUMENTS

| | | |
|---|---|---|
| CN | 1051598 | 5/1991 |
| DE | 3311586 | 10/1984 |
| DE | 10241561 | 3/2004 |
| EP | 0112810 | 7/1984 |
| EP | 0384888 | 8/1990 |
| EP | 1102917 | 5/2001 |
| JP | 11173063 | 6/1999 |
| JP | 11176062 | 7/1999 |
| JP | 11323926 | 11/1999 |
| WO | WO 92/012329 | 7/1992 |
| WO | WO 92/019841 | 11/1992 |
| WO | WO 2004/042193 | 5/2004 |

*Primary Examiner* — William P Neuder
(74) *Attorney, Agent, or Firm* — Mark P. Stone

(57) ABSTRACT

The invention relates to a method and a device for controlling drilling parameters when drilling into rock with a drilling machine. During drilling, an impulse-generating device using an impact means is arranged to induce shock waves in a tool held against the rock, the said impulse-generating device being displaceable in the drilling direction relative to a supporting means, wherein a pressure level of a shock-wave-generating pressure is controlled during the drilling operation. A drilling speed of the said drilling is determined by determining a movement of the impulse-generating device with respect to the said supporting means, and the said shock-wave-generating pressure is controlled as a function of the said drilling speed that has been determined.

20 Claims, 6 Drawing Sheets

METHOD AND DEVICE FOR CONTROLLING AT LEAST ONE DRILLING PARAMETER FOR ROCK DRILLING

FIELD OF THE INVENTION

The present invention relates to a method and a device for controlling at least one drilling parameter when drilling in rock, as specified in the preamble of Claims 1 and 10, respectively.

BACKGROUND OF THE INVENTION

Rock drilling is often carried out by percussion drilling, where a percussion piston, which is often operated hydraulically, is used to create a shock wave with the aid of an impact force that is generated by hydraulic pressure (percussion pressure), the shock wave being transmitted to the drill bit and hence to the rock through the drill steel (drill string). On contact with the rock, pins made of a hard alloy of the drill bit contacting the rock is pushed into the rock, generating a strong enough force to fragment the rock.

It applies in general, and especially in the case of drilling under difficult rock conditions and with a strong impact force, that the drill bit should have as good a contact with the rock as possible.

For this reason, the drilling machine is pressed against the rock: The drilling machine can be attached e.g. to a carriage, which moves along a supporting means, such as a feed beam, which is connected to a carrier, such as a vehicle. The drill bit is forced into the rock by moving the carriage, and therefore the drilling machine, along the feed beam towards the rock. The carriage can be operated e.g. by a hydraulic cylinder, which is usually called a feed cylinder. Alternatively, the drilling machine can be moved forward by using what is called a chain feed, in which case the feed cylinder is replaced by a hydraulic engine (feed engine), fitted with a spur gear. The carriage (the drilling machine) can then be moved forwards and backwards along the beam with the aid of a chain that is fixed to the carriage and is operated by the feed engine, where the chain runs along the feed beam. The hydraulic pressure that actuates the feed cylinder or feed engine is generally called the feed pressure.

The prevailing drilling conditions often change when a drilling machine of this kind is being used for drilling. There are many different types of rock, differing in drillability according to their quality, such as for example hardness. Soft and crumbling rocks are generally considered to represent the most difficult drilling conditions. The risk in the case of drilling into soft rock is that part of the energy of the shock waves is reflected when the rock is being hit and is transmitted back to the drilling machine along the drill string. The consequence of this is that the service life of the drill bit, the drill steel and the drilling machine can be reduced, with associated increases in cost as result. The drilling can be made even more difficult by conditions such as rock types of different hardness lying in a mixed arrangement in various beds.

It applies generally that an increase in the drilling speed (drilling rate) gives an indication that the rock is becoming softer. According to the prior art there are solutions utilizing this fact. In one of the known solutions, a throttle-type regulator or throttle is fitted at the return end of the hydraulic feed motor. If the drilling rate then becomes greater than is considered normal, the throttle begins to reduce the flow through the motor, so that a pressure difference is built up at the return end. The increase in pressure means that the pressure difference over the feed motor is reduced, and when a valve is used that is controlled by this pressure difference, and which in turn influences the percussion pressure, the percussion pressure can be reduced to an initial drilling level or essentially turned off completely when the drill bit enters a region of a softer rock.

Such a solution is described in EP 1,102,917 B1, with the difference that in this case the throttle is placed upstream of the feed engine. In this solution, the pressure over the throttle Valve is measured and is used to influence the percussion pressure if the pressure difference becomes too great.

However, the solutions described above have in common that they are difficult to set appropriately when the drilling rig is installed in a new drilling location. One reason for this is that, whereas a certain pressure difference over the feed motor or the throttle valve may be suitable for reducing the percussion pressure in one type of rock, a completely different pressure difference may be suitable in the case of another type of rock.

There is therefore a need for an improved method and device for controlling the percussion pressure, in particular when the drilling conditions change, which at least reduce problems encountered in the prior art.

OBJECT AND MOST IMPORTANT FEATURES OF THE INVENTION

One of the objects of the present invention is to provide a method for controlling at least one drilling parameter in order to solve the above problem.

Another object of the present invention is to provide a device for controlling at least one drilling parameter in order to solve the above problem.

These and other objects are achieved according to the present invention by a method for controlling the drilling parameters as defined in Claim 1, and by a device according to Claim 10.

According to the present invention, the above objects are achieved with the aid of a method and a device for controlling drilling parameters when drilling in rock with the aid of a pulse-generating device such as a drilling machine. During drilling, an impulse-generating device, such as a drilling machine, using an impact device, such as for example a conventional percussion piston, is arranged to induce shock waves in a tool operating against the rock. The said impulse-generating device is displaceable with respect to a supporting means in the drilling direction, and a pressure level of a shock-wave-generating pressure is controlled during the drilling operation. A drilling speed of the said drilling Operation is determined by determining a movement of the impulse-generating device relative to the said supporting means, and the shock-wave-generating pressure is controlled as a function of the said determined drilling speed. The shock-wave-generating pressure is reduced at an increase in the said drilling speed, and the shock-wave-generating pressure is increased at a decrease in the said drilling speed.

The advantage of this arrangement is that by controlling the shock-wave-generating pressure, such as the percussion pressure, as a function of the actual drilling speed, the right percussion pressure in relation to the prevailing drilling speed can be used in every situation. This in turn means that harmful reflections can be prevented, both in the case of initial drilling and normal drilling. The invention also has the advantage that it makes it possible to reduce uncertainties in the operation of the hydraulic components, which are due e.g. to the viscosity of the oil and the temperature of the surroundings.

The present invention also has the advantage that it provides a system that is simple to adjust, since the speed levels for the beginning and the end of the control and the maximum and minimum values of the percussion pressure during the control operation can be set in a simple way from the control panel of the drilling rig, and can also be changed and adjusted during operation.

The said rock drilling rig can comprise at least one boom having a first end and a second end, where the first end can be fixed to a carrier, and the second end can be fixed to the said supporting means.

Furthermore, the shock-wave-generating pressure can be controlled in such a way that it reflects the changes in the said drilling speed.

During the control, the shock-wave-generating pressure can be varied e.g. between a first level, which essentially corresponds to a normal drilling level, and a second level, which essentially corresponds to any of the following: initial drilling level, basically a stoppage, and a fraction of the said normal drilling level.

The control can be carried out e.g. with the aid of a mathematical relation between the drilling speed and the shock-wave-generating pressure and/or by look-up in a table that gives a relation between the drilling speed and the shock-wave-generating pressure.

This function can comprise e.g. one or more from the following: proportional to the drilling speed, inversely proportional to the drilling speed, exponential to the drilling speed, logarithmic to the drilling speed, and those which are in a certain relationship with the drilling speed.

The drilling speed can be determined e.g. continuously and/or at certain intervals e.g. by sensoring, monitoring, measurement or calculation.

The present invention also relates to a device, by means of which the advantages of what has been described above is obtained.

Other advantages are derived from various aspects of the invention and will emerge from the following detailed description.

DETAILED DESCRIPTION OF PREFERRED EMBODIMENTS

Figure 1:
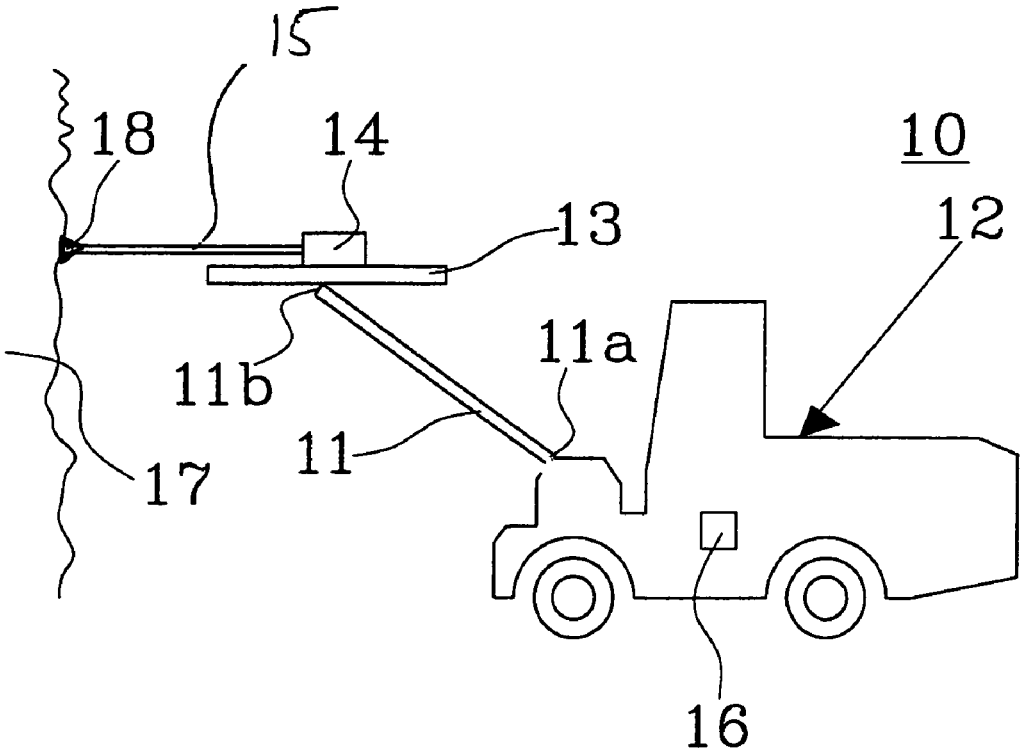
FIG. 1 shows an example of a drilling rig in which the present invention can be used.

The present invention will now be exemplified with reference to a rock drilling rig of the type shown in FIG. 1. FIG. 1 shows a rock drilling rig 10 for tunnelling, ore mining or installing rock reinforcement bolts in the case of e.g. tunnelling or mining. The drilling rig 10 comprises a boom 11, one end 11*a* of which being articulately connected to a carrier 12, such as a vehicle, by means of one or more joints, while its other end 11*b* carries a feed beam 13 that supports an impulse-generating device in the form of a drilling machine 14. The drilling machine 14 can be displaced along the feed beam 13 and generates shock waves that are conveyed to the rock 17 by a drill string 15 and a drill bit 18. The rig 10 also comprises a control unit 16, which can be used to control drilling parameters according to the present invention, as described below. The control unit 16 can be used to monitor the position, direction, drilled distance, etc. in relation to the drilling machine and the carrier. The control unit 16 can also be used for controlling displacement of the rig 10, although a separate control unit can of course also be used for this purpose.

Figure 2:
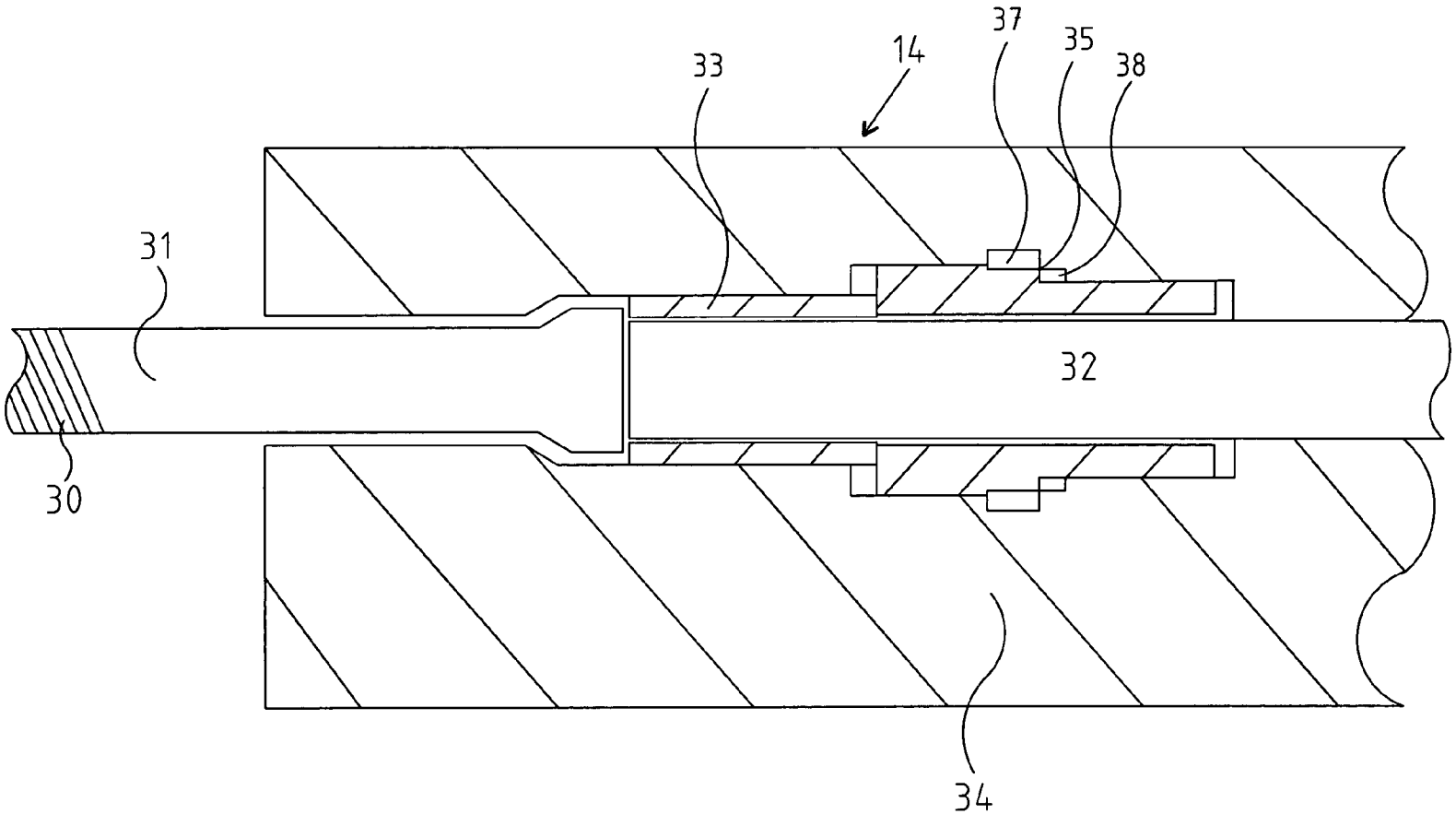
FIG. 2 shows in greater detail the drilling machine arranged on the drilling rig shown in FIG. 1.

FIG. 2 shows the drilling machine 14 in more detail. The drilling machine comprises an adapter 31, one end of which being fitted with means of connection 30, such as for example a screw thread, to establish a connection with a drill string component (not shown) of the drill string 15. The drilling machine also comprises a piston 32 that is movable in the longitudinal direction, which impacts against the adapter 31 to transfer percussion pulses to the drill string (drill steel) and then to the rock. The impacts of this percussion are produced by pressurizing the percussion piston at its end facing away from the rock by a shock-wave-generating pressure (percussion pressure). The bearing pressure of the drill bit towards the rock is varied by means of the abovementioned feed pressure exerted by a damping piston 34 and transmitted through a sleeve 33. The damping piston 34 is arranged in a damping system, which is also used for damping the percussion impact pulses that are reflected back from the rock. In operation, a force that is produced by hydraulic pressure in a first damping chamber 37 is transmitted to the adapter 31 via the damping piston 34 and the sleeve 33, where the said force is used to ensure that the drill bit is pressed against the rock at all times.

In addition to having this function of pressing the drill string against the rock, the damping piston also performs a damping function. When an impact gives rise to reflections from the rock, the piston 34 damps these reflections by being forced into a second damping chamber 38, as a result of which fluid in this second damping chamber 38 is pressed into the first damping chamber 37 through a small slit, formed between the damping piston 34 and the chamber wall 35, when the damping piston 34 is pressed into the second damping chamber 38. This results in a retarding pressure rise in the second damping chamber 38.

Figure 3:
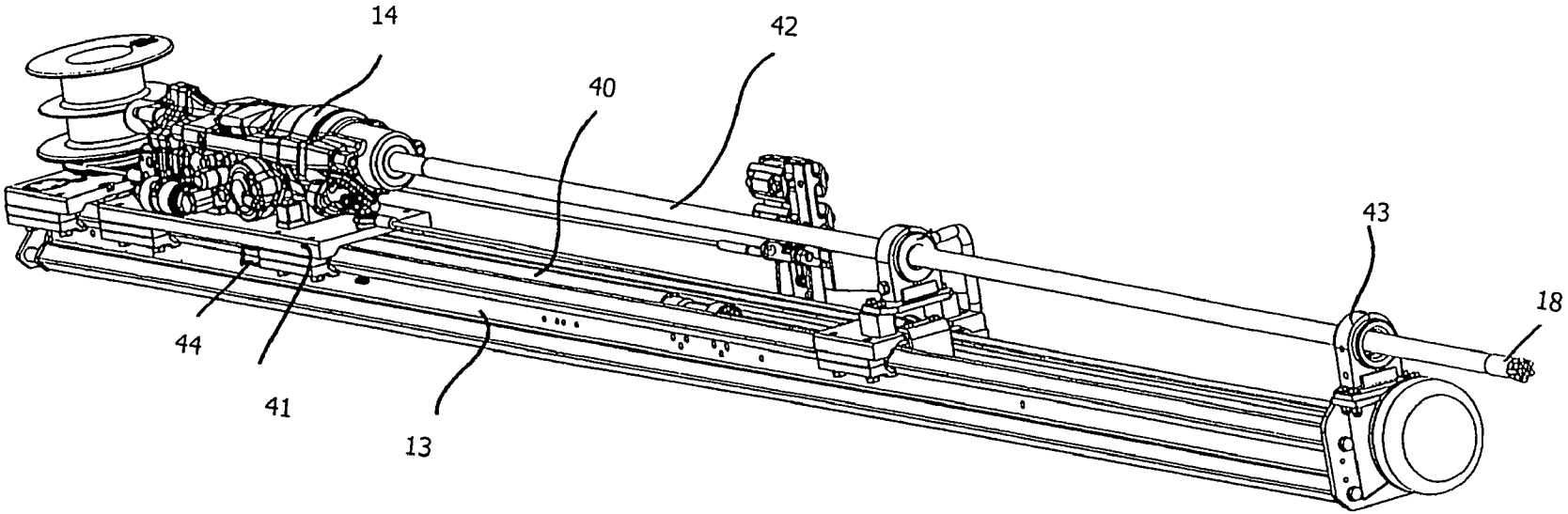
FIG. 3 shows in greater detail a drilling machine and feed beam for the drilling rig illustrated in FIG. 1.

FIG. 3 shows the feed beam 13 with the drilling machine 14 in more detail. The drilling machine 14 is connected to a carriage 41 that can be displaced along the feeder and whose movement along the feed beam 13 is controlled by a feed cylinder 40, which is a hydraulic cylinder in this example. During drilling, the feed beam is set in the drilling position, preferably with the drilling machine 14 displaced as far back as possible, so that a drill string component 42 of a suitable length can be connected to the drilling machine through the said adapter 31 without the drill bit 18 extending too far from a front drill-support 43 arranged at the feed beam 13. When a new borehole is started, the support for the drill. bit and drill string should prevent, as far as possible, the borehole from turning in a wrong direction when drilling is begun. Before starting the drilling operation, the feed beam is therefore controlled in such a way that it is pressed against the rock, whereby the drill bit can be controlled so that it is at a desired (small) distance from the rock. The feed cylinder 40 can then be used to apply a suitable feed pressure to the rock. The drill bit (drill string) is generally made to rotate before it is pressed against the rock in order to begin the drilling operation under the appropriate initial drilling conditions. As the drilling proceeds, the feed cylinder moves the drilling machine in the direction of the rock, so that—when the carriage 40 has been displaced in the direction of the rock to a front end position—it is uncoupled from the drill string that has been drilled into the rock, so that a new drill string component can be connected between the drilling machine and the drill string component 42, whereby the drilling can continue until a borehole of the required length is obtained. If the drill string component 42 itself has produced a hole of the required depth, no further drill string component needs to be used of course.

As mentioned above, the pressure applied to the feed cylinder 40 is used in the prior art to determine whether the drilling operation is too fast, i.e. if the rock type that is being drilled is soft, or if the drilling has reached a cavity, so that the percussion pressure can be reduced or stopped altogether in dependence thereof in order to prevent harmful reflections. However, this method of determining whether the drilling is proceeding too fast has the disadvantage that it only gives an estimated drilling speed, which may be quite different from the actual drilling speed. Furthermore, owing to the fact that this known solution is based on hydraulic components, it may be difficult to adjust the percussion pressure in dependence of the feed pressure in a satisfactory way. This is partly because various types of rock may call for different changes to the percussion pressure in dependence of the feed pressure. If the rock is hard, the percussion pressure has to be reduced at a certain feed pressure, while drilling a soft rock calls for the reduction of the percussion pressure at a completely different feed pressure. Furthermore, a feeder that is not maintained correctly or not adjusted correctly means that the pressure changes are not equally evident, which makes the control even more difficult.

The present invention at least reduces the disadvantages of current systems and is described below in more detail with reference to FIGS. 3 and 4. Instead of using the hydraulic pressure for controlling the percussion pressure, the speed of the drilling machine relative to a support, such as the feed beam 13, is used for this purpose according to the present invention. The use of the speed of the drilling machine relative to the feed beam provides a significantly more accurate basis for the control than the type of control that is based on the hydraulic pressure or fluid flow, so that a significantly more accurate control of the percussion pressure can be obtained as well.

According to the present invention, the drilling speed is determined e.g. with the aid of a speed sensor 44, which measures the speed of the drilling machine (carriage) with respect to the feed beam. Alternatively, a position sensor can be used for measuring the change in the position of the drilling machine (carriage) with time, from which the speed can then be determined in a conventional manner. The position sensor can be used e.g. to measure the relative movement along the feed beam, which can be done e.g. by using an IR sensor arranged on the carriage (or feed beam) to detect the movement (speed) against a reading scale arranged on the feed beam (carriage), whereby the reflected light can be used to determine the position. The reading scale can be arranged either in such a way that only the relative movement is detected, or in such a way that the absolute position is detected with the aid of e.g. a suitable coding that can be detected by the IR sensor.

The sensor 44 is arranged on the carriage 41 in FIG. 3. However, the present invention is not restricted to the use of IR sensors, but instead any other suitable sensor can also be used, such as for example a laser sensor.

Figure 4:
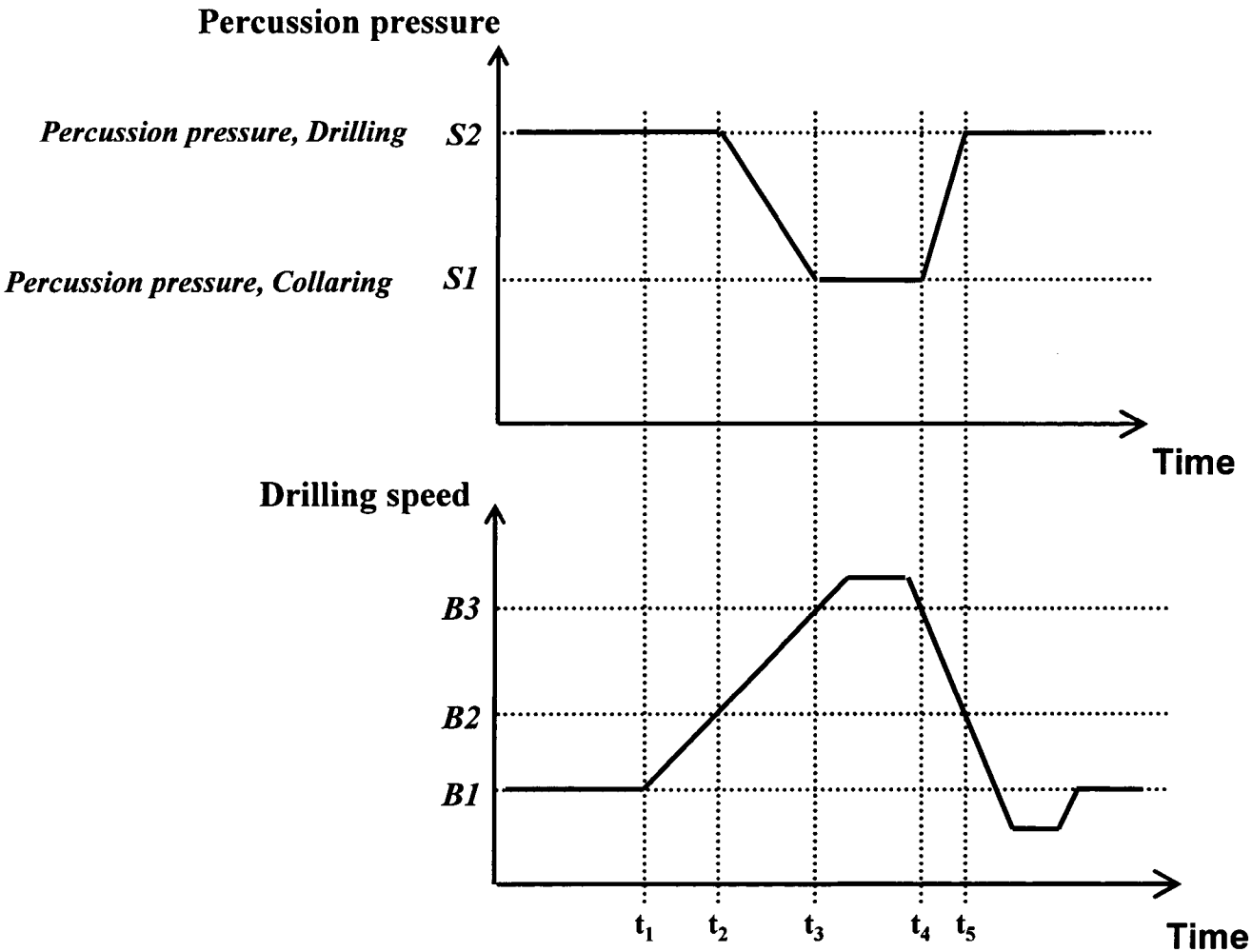
FIG. 4 shows an example of the control of the percussion pressure according to the actual drilling speed.

FIG. 4 shows an example of the control of the percussion pressure according to the actual drilling speed. FIG. 4 shows two graphs; the top graph shows the percussion pressure as a function of time and its variation with the drilling speed, while the bottom graph shows the drilling speed as a function of time. As can be seen in this figure, the percussion pressure is controlled between a first level S1 and a second level S2. The first level S1 is a reduced level, at which the percussion pressure is considered to be low, such as for example a percussion pressure for initial drilling, while the second level S2 is the normal drilling level, i.e. a level where the percussion pressure is at a value that is considered necessary for the specific rock type. It will be realized that in practice these levels can vary with the type of rock in question.

As can be seen from FIG. 4, the percussion pressure is allowed to stay at the normal drilling level so long as the drilling speed is lower than a certain speed, which is given in FIG. 4 as B2. It can also be seen from this figure that the speed B2 is set higher than the drilling speed (drilling rate) B1 that is considered normal for the rock in question. This allows for a certain variation in the drilling speed before the control according to the present invention begins. The value that is considered to be the normal drilling speed can be determined e.g. by drilling one or more test holes at a suitable place, e.g. where the rock is known to be homogeneous and to have a hardness that is characteristic of the region where drilling is to be performed. The value of B2 can, for example, be given as x% of the normal drilling speed B1, where x is greater than 100.

Control according to the present invention is begun when the drilling speed exceeds the speed B2. This control is maintained as long as the drilling speed remains e.g. between the drilling speed values 32 and B3 shown in FIG. 4.

At time t2, the drilling speed exceeds the speed B2, and the reduction of the percussion pressure begins when the drilling speed exceeds this speed. In the example illustrated here, the control of the percussion pressure is proportional to the drilling speed, that is to say, if the increase in the drilling speed is linear, the decrease in the percussion pressure is also linear. When the drilling speed then reaches the higher speed B3 at time t3, the percussion pressure is reduced to the initial drilling level S1 (or to another suitable level) for as long as the drilling speed is equal to the drilling speed B3 or exceeds it, as shown in the interval between t3 and t4. When then the drilling speed again drops below the drilling speed B3 at time t4, the percussion pressure again follows the drilling speed proportionally in order to adopt the normal drilling speed again at time t5. This then persists until the drilling speed again exceeds the speed B2 or the drilling operation is terminated. Instead of reducing the percussion pressure to the initial drilling level, it can be reduced to any arbitrary fraction of the prevailing normal drilling pressure, or else stopped completely, when the drilling speed exceeds the speed B3.

In addition to reducing the disadvantages of the prior art, the invention also has the advantage that the number of hydraulic components needed is reduced; these components are not only relatively expensive but also have an unstable operation, partly because their operation varies with the viscosity of the oil, which in turn depends on the temperature of the surroundings and the type of oil used. The present invention also has the advantage that the effect of inertia and friction, which will arise in the feed beam with time, can be reduced or eliminated completely.

The present invention has so far been illustrated in the case of linear control. However, the percussion pressure can of course be controlled also according to any arbitrary function of the drilling speed. For example, the percussion pressure can be arranged to decrease and increase exponentially or logarithmically with the drilling speed. It is advantageous to use a mathematical function, which easily can be programmed e.g. into the control unit 16 and which can be used for the purposes of control. Alternatively, the function can be one found in a table that can be used to look-up a percussion pressure that corresponds to a given drilling speed.

In an alternative embodiment, the percussion pressure is raised in steps, so that a certain increase or decrease in the drilling speed causes a step up or down, respectively. However, each step is small in comparison with the overall difference between the first level S1 and the second level S2.

Figure 5:
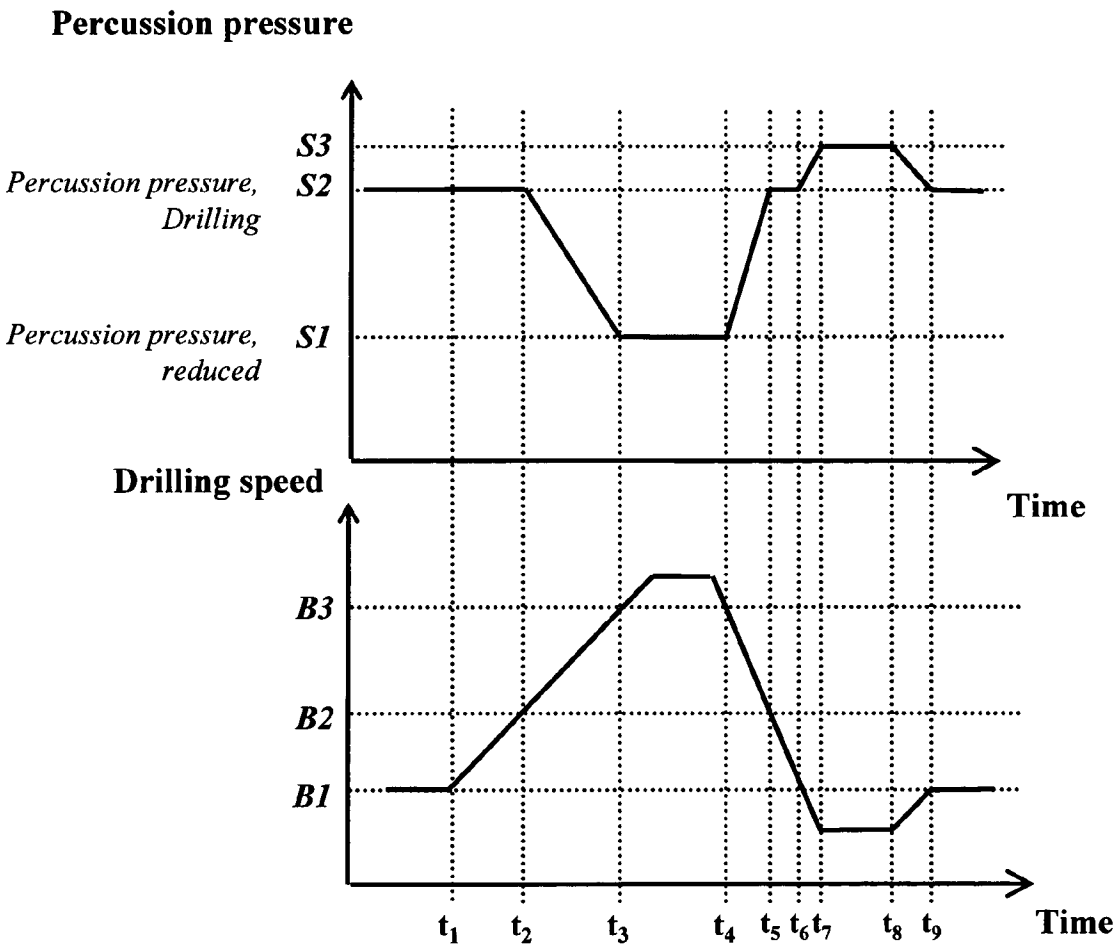
FIG. 5 shows an example of the control of the percussion pressure according to another embodiment of the present invention.

FIG. 5 shows another embodiment of the present invention. Until time t5, this is the same as the one shown in FIG. 4, but now there is another level S3 for the percussion pressure, at which the percussion pressure is higher than the normal drilling pressure S2. In this embodiment, the percussion pressure is allowed to rise up to the level S3 when the drilling speed drops below the normal drilling speed B1 at time t6. For example, as shown in the figure for the interval between t6 and t7, the control described above can still be used in this case to make the percussion pressure follow the drilling speed when this drops below the normal drilling speed. Letting the percussion pressure exceed the normal drilling pressure has the advantage that drilling is made easier or simply possible e.g. where the drilled rock is interspersed with strata of a significantly harder rock. It can happen in such situations that the percussion pressure S2 used for normal drilling is insufficient to break the hard rock. If in this situation the percussion pressure is raised to a level that exceeds the normal pressure, the energy of the shock waves released increases, which makes it possible to penetrate the sections containing the harder rock. When harder rock parts have been penetrated and the drilling speed increases again, between t8 and t9 in FIG. 5, so that the normal drilling speed B1 is reached again at time t9, the percussion pressure is controlled appropriately to ensure that the normal drilling level S2 is reached again at time t9.

The above description only deals with the control of the percussion pressure according to the drilling speed. However, this control can also be combined with control of the feed pressure. In other words, the feed pressure can also be arranged to be controlled on the basis of the drilling speed according to the same principle, so that the feed force is reduced when the drilling speed increases, and/or raised when the drilling speed decreases. The effect of the drilling speed on the feed pressure and the percussion pressure can be arranged to be different for the respective pressure control. For example, the relative change in the percussion pressure can be greater than the relative change in the feed pressure, and vice versa. Similarly the percussion pressure can be controlled linearly, e.g. according to a first mathematical function, while the feed pressure is controlled e.g. in a non-linear manner according to a second function.

As indicated above in the case of the percussion pressure, the feed pressure can also be controlled between two levels, such as an initial drilling level and a normal drilling level, which can of course be different for different types of rock. Furthermore, the control of the feed pressure can also be arranged to be performed to an arbitrary fraction of the prevailing normal drilling pressure, or the feed pressure can be stopped completely when the drilling speed exceeds e.g. the speed B3.

Figure 6:
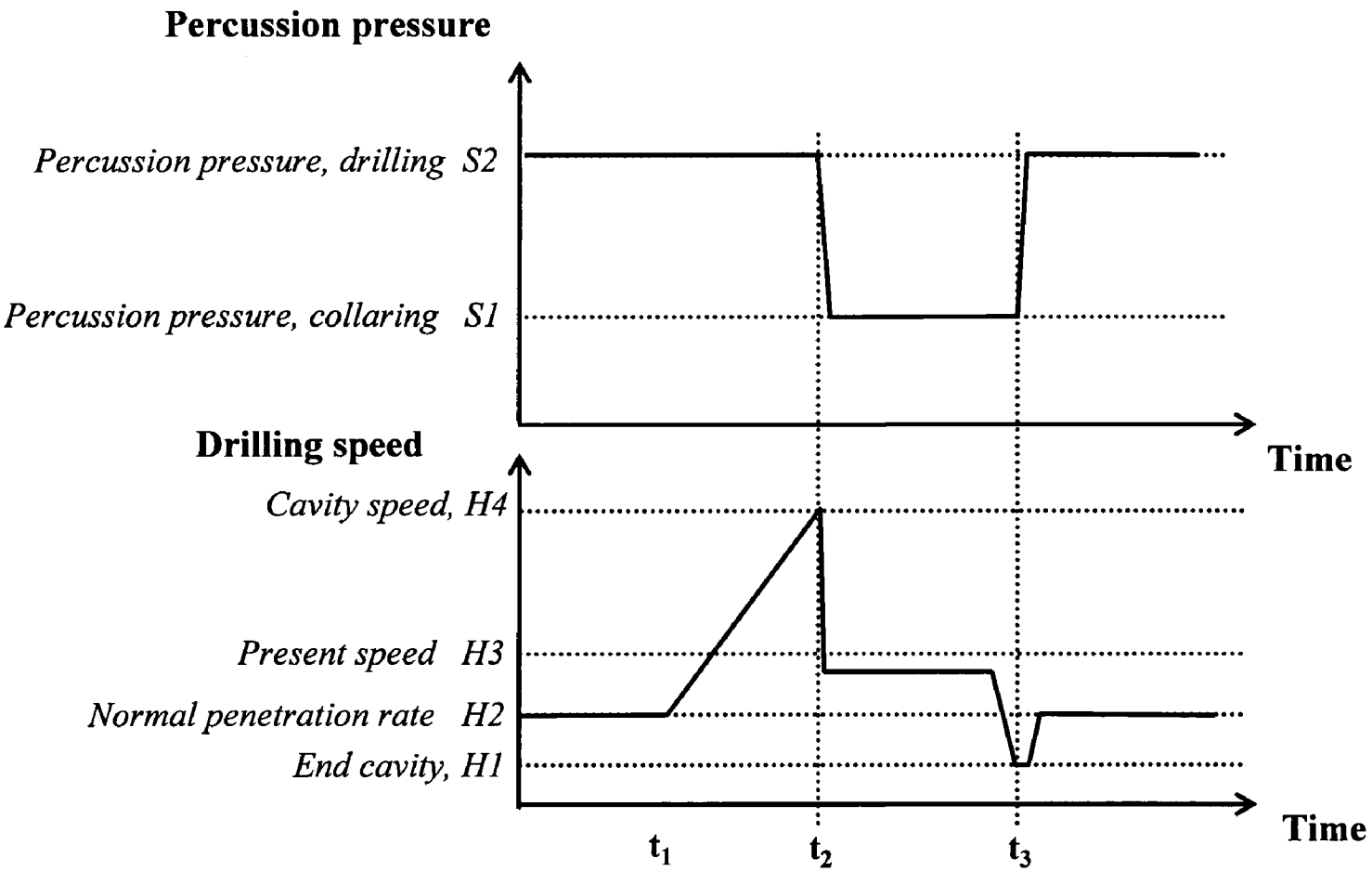
FIG. 6 shows an example of control in the case of cavity detection according to an embodiment of the present invention.

FIG. 6 shows a drilling application where the present invention can advantageously be used. As mentioned before, soft and crumbly rocks are the most difficult to drill. When the drill bit encounters a cavity during drilling, the resistance suddenly drops, and the drilling speed greatly increases, whereby the control described above can be employed when the speed increases. However, problems can arise if the drilling speed rises to an excessively high value. If for example the cavity is filled with clay, apertures included in the drill bit for discharging the flushing medium in order to flush the borehole during the drilling operation can be clogged up, which involves the risk that the cuttings, i.e. the rubble formed in the drilling, block the borehole and so they hamper the withdrawal of the drill string from the hole at the end of the drilling operation. Another problem that can arise if the drilling speed rises excessively is that the drilling equipment can be damaged when the drill bit finally reaches the other end of the cavity and is subject to a sudden stop.

In the case when the device according to the present invention encounters a cavity and the drilling speed therefore increases, so that at least the percussion pressure is reduced for the reason described above, the speed increase is reduced in comparison with a system that does not include control according to the present invention, and the speed increase can even stop altogether, even if only at a relatively high speed, such as for example that seen between t3 and t4 in FIG. 4.

The solutions mentioned in the background of the invention section above can also be used for dealing with such situations. In the case a throttle is fitted at the return end of a hydraulic feed engine, this begins to reduce the flow When the drilling rate exceeds the value considered normal and, as mentioned above, the pressure difference over the feed engine decreases, which, apart from reducing the percussion pressure as described above, also ensures that in turn the momentum of the feed motor decreases and so a further increase in the drilling speed is prevented.

In the solution described in EP 1,102,917 B1, too, the throttle fitted upstream of the feed engine ensures that the drilling speed does not rise any further.

However, both the present invention and the previously known solution suffer from the fact that the speed through the cavity does not drop below the normal drilling speed; in fact, the speed through the cavity can even be substantially higher than the normal drilling speed, as shown above in connection with FIG. 4. It is especially in the case of loose types of rock, where the normal drilling rate is relatively high, that this circumstance means that the speed can be high when the drill bit hits rock again, with the immediate risk of damage as a result. According to one aspect of the present invention, however, this risk of damage can be reduced, since the present invention makes it possible to electronically set a number of control levels for the feed pressure and the percussion pressure, and in such a way that that they do not affect the system during normal drilling. This electronic control according to the invention can be set in such a way that the feed pressure and/or the percussion pressure can be controlled just when the drilling speed exceeds a certain value, which—thanks to the fact that the drilling speed can be accurately determined according to the present invention—can be a value that lies above, but is still very close to, a speed that represents the normal drilling speed. This allows control of the feed pressure and/or the percussion pressure that is rapid, so that a small difference in speed can give rise to a large effect on the pressure that is being controlled.

The invention therefore makes it possible to perform drilling operation with unaffected parameters at any speed up to this value. In the case of solutions according to the prior art, on the other hand, this is considerably more difficult, because the control in these cases is based on hydraulic throttling, where the magnitude of throttling influences the control. This has the drawback that it can be difficult to obtain a throttle function that gives a sufficiently great throttling effect at a speed that is only slightly greater than the normal drilling speed without this throttling starting up already at a lower speed, which then affects the percussion pressure and/or the percussion pressure for normal drilling operation.

This case is exemplified by the embodiment of the present invention shown in FIG. 6, which illustrates how situations where the drill bit encounters a cavity can be dealt with in a simple way. According to this embodiment, the drilling speed is monitored, and when it exceeds a speed H4 (which represents a first "cavity speed", i.e. a speed that is higher than the value that can be reached when drilling into rock), the feed rate (drilling speed), the feed pressure and the percussion pressure are all set to predetermined levels until the end of the cavity is detected. The time diagram shown in FIG. 6 starts under normal conditions where the drilling is being carried out at a high percussion pressure S2 (which is the normal drilling pressure for the type of rock in question), while at the same time the drilling proceeds at the normal speed H2. At time t1, the drilling speed starts to rise because the drill bit encounters the wall of a cavity. When the drilling speed reaches—at time t2—the "cavity speed" H4, which is higher than or equal to the speed B3 shown in FIG. 5, the speed drops to a predetermined "transport speed" H3, while at the same time the percussion pressure is reduced to a "collaring" or initial pressure S1, or to another suitable pressure level.

The speed and pressure settings are then maintained until the speed is reduced at time t3 to below the normal drilling speed and to a second cavity speed H1, which is lower than the transport speed H2, at which the cavity is considered to have been traversed and contact with rock is re-established. The speed drops to the lower value H1 when the drill bit again comes into contact with rock, because the reduced percussion pressure is not sufficient to break through the rock at the normal speed. When contact with the rock is detected in this way, the percussion pressure limitation and the drilling speed limitation are changed to values used in the case of a normal drilling operation, whereby the percussion pressure is allowed to rise again to the normal drilling pressure S2 whereby the drilling speed is also increased, so that it once more reaches the normal drilling speed H2 that is appropriate for the rock type in question, owing to the raised percussion pressure. The increase in the percussion pressure can be rapid, as shown in the figure; alternatively, it is represented by a suitable "collaring" operation in order to prevent the risk of borehole deviation.

The solution shown in FIG. 6 can also be combined with a number of other functions. Percussion drilling often involves a rotation (indexing) of the drill string to ensure that the pins of the drill bit hit new rock with each impact. This rotary speed can be e.g. increased, or it can be decreased during passage through a cavity. Alternatively or in addition to this, the flushing pressure can be raised in order to reduce the risk of the flushing aperture of the drill bit being clogged up.

The embodiment shown in FIG. 6 has the advantage that the passage of the drill bit through a cavity becomes a highly controlled operation. Since the speed can be kept at a low value, it is possible to reduce considerably the risk of damage on contact with rock. Furthermore, the cavity speed (transport speed) can be so set as to be higher or lower than the normal drilling speed, depending on the hardness of the rock that, is being drilled. The solution shown in FIG. 6 also has the advantage that it is easy to set up. The speed settings when a cavity is considered to be detected and when contact with rock is re-established can be controlled in a simple way from the control panel of the rig and can also be adjusted while drilling is in progress.

As shown above, the present invention can be used both for initial drilling and normal drilling. It is particularly advantageous when the rock contains numerous fissures and/or its hardness varies greatly, so that the drill steel occasionally loses contact with rock, in which case the risk of harmful reflections can be reduced.

Furthermore, the present invention has been described herein in connection with a percussion drilling machine that comprises a percussion piston, where the energy of the percussion or impact pulses in principle consists of the kinetic energy of the percussion piston, which is transmitted to the drill steel. However, the invention can also be used with other types of impulse-generating systems, such as those in which the shock-wave energy is instead generated by pressure pulses that are transmitted to the drill string from an energy storage through an impact means that only performs a very small movement.

It will be realized, but it should still be mentioned for the sake of clarity, that the term "control of pressure according to the speed", as used in the present invention does not include the type of control in which the percussion pressure is suddenly reduced from the normal drilling pressure to for example the initial drilling pressure as soon as the drilling speed exceeds a threshold value.

Furthermore, although the invention has been illustrated in the above description in the case of an underground drilling rig, the invention can also be used for drilling rigs operating above ground, as well as in drilling applications other than those described above.

The invention claimed is:

1. Method for controlling at least one drilling parameter when drilling into rock, where an impulse-generating device using an impact means is arranged to induce shock waves in a tool held against the rock, the said impulse-generating device being displaceable in the drilling direction relative to a supporting means, wherein a pressure level of a shock-wave-generating pressure is controlled during the drilling operation, characterized in that said method comprises the following steps:

determining an actual drilling speed for the said drilling operation by determining a movement of the impulse-generating device with respect to the said supporting means, and controlling the said shock-wave-generating pressure as a function of the said drilling speed that has been determined, where the shock-wave-generating pressure is reduced at an increase in the said drilling speed, and where the shock-wave-generating pressure is increased at a decrease in the said drilling speed.

2. Method according to claim 1, where the said control is carried out after initial drilling has been completed.

3. Method according to claim 1, characterized in that the said drilling speed is determined by determining positional changes of the said impulse-generating device relative to the said supporting means.

4. Method according to claim 1, characterized in that the said control of the shock-wave-generating pressure as a function of the drilling speed is performed when the drilling speed exceeds a first speed.

5. Method according to claim 1, characterized in that said method further includes the step of — when the said drilling speed drops below a normal drilling speed — the shock-wave-generating pressure is controlled as a function of the said drilling speed, whereby the shock-wave-generating pressure is increased to a level above a normal drilling level.

6. Method according to claim 1, where the said control is carried out after initial drilling has been completed.

7. Method according to claim 1, characterized in that the said drilling speed is determined by determining positional changes of the said impulse-generating device relative to the said supporting means.

8. Device for controlling at least one drilling parameter when drilling into rock, where an impulse-generating device using an impact means is arranged to induce shock waves in a tool held against the rock, the said impulse-generating device being displaceable in the drilling direction relative to a supporting means, and where a pressure level of a shock-wave-generating pressure is controlled during drilling, characterized in that said device includes:

means for determining an actual drilling speed for the said drilling operation by determining a movement of the impulse-generating device with respect to the said supporting means, and means for controlling the said shock-wave-generating pressure as a function of the said drilling speed that has been determined, where the device further comprises means for, when controlling the shock-wave-generating pressure, reducing the shock-wave-generating pressure at an increase in the said drilling speed, and increasing the shock-wave-generating pressure at a decrease in the said drilling speed.

9. Device according to claim 8, characterized in that the said supporting means consists of a feed beam.

10. Device according to claim 9. characterized in that the said control is arranged to be carried out after initial drilling has finished.

11. Device according to claim 9, characterized in that the said means for determining the said drilling speed is arranged to establish the drilling speed by determining positional changes of the said impulse-generating device relative to the said supporting means.

12. Device according to claim 9, characterized in that the said means for determining the drilling speed is arranged to determine a movement of the said impulse-generating device relative to the support with the aid of sensor means.

13. Device according to claim 8, characterized in that the said control is arranged to be carried out after initial drilling has finished.

14. Device according to claim 8, characterized in that the said means for determining the said drilling speed is arranged to establish the drilling speed by determining positional changes of the said impulse-generating device relative to the said supporting means.

15. Device according to claim 8, characterized in that the said means for determining the drilling speed is arranged to determine a movement of the said impulse-generating device relative to the support with the aid of sensor means.

16. Device according to claim 8, characterized in that the said means for controlling the shock-wave-generating pressure according to the drilling speed is arranged to perform the control when the drilling speed exceeds a first speed.

17. Device according to claim 8, characterized in that said device further includes means for, when the drilling speed drops below a normal drilling speed, controlling the shock-wave-generating pressure as a function of the said drilling speed, where the shock-wave-generating pressure is raised to a level above a normal drilling level.

18. Device according to claim 8, characterized in that said device further includes means for setting the maximum feed rate (drilling speed) of the impulse-generating device at a predetermined speed when the said drilling speed exceeds a first cavity speed, where the said first cavity speed represents a speed at which it is found that the drilling has reached a cavity.

19. Device according to claim 18, characterized in that said device further includes means for — after the detection of said first cavity speed — increasing the said shock-wave-generating pressure to a normal drilling pressure when the drilling speed drops below a second, lower cavity speed, representing a speed at which the drilling has reached the end of the said cavity.

20. Rock drilling rig, characterized in that said rock drilling rig comprimises a device according to claim 8.

* * * * *